US012453371B2

(12) United States Patent
Dittmann et al.

(10) Patent No.: US 12,453,371 B2
(45) Date of Patent: Oct. 28, 2025

(54) AEROSOL-GENERATOR COMPRISING A SUPPLY ELEMENT

(71) Applicant: Philip Morris Products S.A., Neuchatel (CH)

(72) Inventors: Leander Dittmann, Neuchatel (CH); Robert Emmett, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 414 days.

(21) Appl. No.: 17/787,920

(22) PCT Filed: Dec. 22, 2020

(86) PCT No.: PCT/EP2020/087603
§ 371 (c)(1),
(2) Date: Jun. 21, 2022

(87) PCT Pub. No.: WO2021/130214
PCT Pub. Date: Jul. 1, 2021

(65) Prior Publication Data

US 2023/0012564 A1 Jan. 19, 2023

(30) Foreign Application Priority Data

Dec. 23, 2019 (EP) ..... 19219428

(51) Int. Cl.
*A24F 40/48* (2020.01)
*A24F 40/05* (2020.01)
(Continued)

(52) U.S. Cl.
CPC ..... *A24F 40/05* (2020.01); *A24F 40/10* (2020.01); *A24F 40/50* (2020.01)

(58) Field of Classification Search
None
See application file for complete search history.

(56) References Cited

U.S. PATENT DOCUMENTS 3,938,062 A 2/1976 Hopp et al.
11,717,845 B2 * 8/2023 Courbat ..... B05B 17/0684 239/4
(Continued)

FOREIGN PATENT DOCUMENTS

CN 206025223 U 3/2017
CN 206025224 U 3/2017
(Continued)

OTHER PUBLICATIONS

English Translation of JP2012248256 (Year: 2024).*
(Continued)

*Primary Examiner* — Philip Y Louie
*Assistant Examiner* — Eric M Fierce
(74) *Attorney, Agent, or Firm* — Oblon, McClelland, Maier & Neustadt, L.L.P.

(57) ABSTRACT

An aerosol-generator for an aerosol-generating device is provided, the aerosol-generator including: a surface acoustic wave atomiser including a substrate including an active surface defining at least one atomisation region, and at least one transducer positioned on the active surface to generate surface acoustic waves on the active surface; and a supply element arranged to supply a liquid aerosol-forming substrate to the atomisation region, the supply element including a channel extending through the substrate between an inlet to receive a supply of the liquid aerosol-forming substrate and an outlet positioned within the atomisation region of the active surface, in which the channel has at least one of a cross-sectional area that varies in a direction from the inlet to the outlet and a portion that extends in a non-perpendicular direction with respect to the active surface. An aerosol-generating device including the aerosol-generator is also provided.

14 Claims, 9 Drawing Sheets

(51) Int. Cl.
*A24F 40/10* (2020.01)
*A24F 40/50* (2020.01)

(56) References Cited

U.S. PATENT DOCUMENTS

| | | | |
|---|---|---|---|
| 2013/0306084 | A1 | 11/2013 | Flick |
| 2015/0245654 | A1 | 9/2015 | Memari et al. |
| 2015/0245655 | A1 | 9/2015 | Memari et al. |
| 2015/0245656 | A1 | 9/2015 | Memari et al. |
| 2015/0245657 | A1 | 9/2015 | Memari et al. |
| 2015/0245662 | A1 | 9/2015 | Memari et al. |
| 2015/0245663 | A1 | 9/2015 | Memari et al. |
| 2015/0245664 | A1 | 9/2015 | Memari et al. |
| 2015/0245665 | A1 | 9/2015 | Memari et al. |
| 2015/0245666 | A1 | 9/2015 | Memari et al. |
| 2015/0245667 | A1 | 9/2015 | Memari et al. |
| 2015/0245668 | A1 | 9/2015 | Memari et al. |
| 2015/0359266 | A1 | 12/2015 | Memari et al. |
| 2016/0150824 | A1 | 6/2016 | Memari et al. |
| 2016/0192712 | A1 | 7/2016 | Memari et al. |
| 2016/0192713 | A1 | 7/2016 | Memari et al. |
| 2017/0360105 | A1 | 12/2017 | Memari et al. |
| 2017/0360106 | A1 | 12/2017 | Memari et al. |
| 2017/0360107 | A1 | 12/2017 | Memari et al. |
| 2017/0360108 | A1 | 12/2017 | Memari et al. |
| 2017/0360109 | A1 | 12/2017 | Memari et al. |
| 2017/0360110 | A1 | 12/2017 | Memari et al. |
| 2017/0360111 | A1 | 12/2017 | Memari et al. |
| 2017/0360112 | A1 | 12/2017 | Memari et al. |
| 2017/0360113 | A1 | 12/2017 | Memari et al. |
| 2017/0360114 | A1 | 12/2017 | Memari et al. |
| 2017/0360115 | A1 | 12/2017 | Memari et al. |
| 2017/0360116 | A1 | 12/2017 | Memari et al. |
| 2018/0000162 | A1 | 1/2018 | Memari et al. |
| 2018/0000163 | A1 | 1/2018 | Memari et al. |
| 2018/0049474 | A1 | 2/2018 | Memari et al. |
| 2018/0049475 | A1 | 2/2018 | Memari et al. |
| 2018/0271158 | A1 | 9/2018 | Memari et al. |
| 2018/0271159 | A1 | 9/2018 | Memari et al. |
| 2018/0271160 | A1 | 9/2018 | Memari et al. |
| 2018/0271161 | A1 | 9/2018 | Memari et al. |
| 2018/0271162 | A1 | 9/2018 | Memari et al. |
| 2018/0271163 | A1 | 9/2018 | Memari et al. |
| 2018/0271164 | A1 | 9/2018 | Memari et al. |
| 2018/0271165 | A1 | 9/2018 | Memari et al. |
| 2018/0271166 | A1 | 9/2018 | Memari et al. |
| 2018/0271167 | A1 | 9/2018 | Memari et al. |
| 2018/0335280 | A1 | 11/2018 | Flick |
| 2019/0037916 | A1 | 2/2019 | Kuempel et al. |
| 2019/0069603 | A1 | 3/2019 | Memari et al. |
| 2020/0008483 | A1 | 1/2020 | Memari et al. |
| 2020/0008484 | A1 | 1/2020 | Memari et al. |
| 2020/0008485 | A1 | 1/2020 | Memari et al. |
| 2020/0008486 | A1 | 1/2020 | Memari et al. |
| 2020/0008487 | A1 | 1/2020 | Memari et al. |
| 2020/0008488 | A1 | 1/2020 | Memari et al. |
| 2020/0008489 | A1 | 1/2020 | Memari et al. |
| 2020/0008490 | A1 | 1/2020 | Memari et al. |
| 2020/0008491 | A1 | 1/2020 | Memari et al. |
| 2020/0008492 | A1 | 1/2020 | Memari et al. |
| 2020/0022420 | A1 | 1/2020 | Memari et al. |
| 2020/0214352 | A1 | 7/2020 | Memari et al. |
| 2020/0232766 | A1 | 7/2020 | Flick |
| 2021/0022406 | A1* | 1/2021 | Minami ..... B05B 17/0607 |
| 2021/0045449 | A1 | 2/2021 | Memari et al. |

FOREIGN PATENT DOCUMENTS

| | | | | |
|---|---|---|---|---|
| CN | 108030153 | A | | 5/2018 |
| CN | 108348700 | A | | 7/2018 |
| CN | 108697178 | A | | 10/2018 |
| CN | 109688848 | A | | 4/2019 |
| EA | 033136 | B1 | | 8/2019 |
| EP | 2 870 888 | A1 | | 5/2015 |
| EP | 3 574 778 | A1 | | 12/2019 |
| FR | 2 742 056 | A1 | | 6/1997 |
| JP | 2006-116448 | A | | 5/2006 |
| JP | 2008-73570 | A | | 4/2008 |
| JP | 2012148256 | A | * | 8/2012 |
| RU | 2 051 755 | C1 | | 1/1996 |
| RU | 108 971 | U1 | | 10/2011 |
| RU | 2 654 619 | C1 | | 5/2018 |
| WO | WO 2017/148829 | A1 | | 9/2017 |
| WO | WO 2017/167521 | A1 | | 10/2017 |
| WO | WO 2019/185746 | A1 | | 10/2019 |
| WO | WO 2019/198684 | A1 | | 10/2019 |
| WO | WO 2019/198688 | A1 | | 10/2019 |
| WO | WO 2021/129986 | A1 | | 7/2021 |

OTHER PUBLICATIONS

Combined Russian Office Action and Search Report issued Apr. 3, 2024 in Russian Patent Application No. 2022119794/03 (with English Translation of Category of Cited Documents), 11 pages.
International Search Report issued Mar. 15, 2021 in PCT/EP2020/087603 filed on Dec. 22, 2020, 6 pages.
Written Opinion issued issued Mar. 15, 2021 in PCT/EP2020/087603 filed on Dec. 22, 2020, 5 pages.
Extended European Search Report issued Sep. 17, 2020 in European Patent Application No. 19219428.0, 14 pages.
Japanese Office Action issued Dec. 2, 2024 in Japanese Patent Application No. 2022-537430 (with English Translation), 5 pages.
Office Action and Search Report issued Apr. 25, 2025, in corresponding Chinese Patent Application No. 202080089326.X; with English Translation; citing documents 15-19 therein.

* cited by examiner

AEROSOL-GENERATOR COMPRISING A SUPPLY ELEMENT

The present disclosure relates to aerosol-generators for an aerosol-generating device, the aerosol-generators each comprising a surface acoustic wave atomiser and a supply element. The present disclosure also relates to aerosol-generating devices comprising the aerosol-generators.

Aerosol-generating systems in which an aerosol-forming substrate is heated rather than combusted are known in the art. Typically in such aerosol-generating systems, an aerosol is generated by the transfer of energy from an aerosol-generator of an aerosol-generating device to an aerosol-forming substrate. For example, known aerosol-generating devices comprise a heater arranged to heat and vaporise a liquid aerosol-forming substrate.

It is desirable to provide a consistent user experience for a user of an aerosol-generating device. However, known aerosol-generating devices may provide insufficient control of the rate at which a liquid aerosol-forming substrate is supplied to an aerosol-generator, such as a heater. Known aerosol-generating device may also provide insufficient control of the rate at which an aerosol-generator vaporises a liquid aerosol-forming substrate. Both of these shortcomings with known aerosol-generating devices may result in an inconsistent user experience.

It would be desirable to provide an aerosol-generator for an aerosol-generating device that provides improved control of the rate at which a liquid aerosol-forming substrate is supplied to an atomisation region of the aerosol-generator.

It would be desirable to provide an aerosol-generator for an aerosol-generating device that provides improved control of the rate at which a liquid aerosol-forming substrate is atomised from an atomisation region of the aerosol-generator.

According to a first aspect of the present disclosure there is provided an aerosol-generator for an aerosol-generating device, the aerosol-generator comprising a surface acoustic wave atomiser and a supply element. The surface acoustic wave atomiser comprises a substrate comprising an active surface defining at least one atomisation region. The surface acoustic wave atomiser also comprises at least one transducer positioned on the active surface of the substrate for generating surface acoustic waves on the active surface of the substrate. The supply element is arranged to supply a liquid aerosol-forming substrate to the at least one atomisation region of the surface acoustic wave atomiser. The supply element comprises a channel extending through the substrate between an inlet for receiving a supply of a liquid aerosol-forming substrate and an outlet positioned within the at least one atomisation region of the active surface of the substrate. The channel has at least one of a cross-sectional area that varies in a direction from the inlet to the outlet and a portion that extends in a non-perpendicular direction with respect to the active surface.

The term "surface acoustic wave" is used herein to include Rayleigh waves, Lamb waves and Love waves.

Advantageously, atomising a liquid aerosol-forming substrate using a surface acoustic wave atomiser provides improved control of the atomisation process when compared to other known aerosol-generators, such as electric heaters. In other words, the surface acoustic wave atomiser of aerosol-generators according to the present disclosure provides reliable and consistent amounts of atomised liquid aerosol-forming substrate.

Advantageously, the power required by a surface acoustic wave atomiser for atomising a liquid aerosol-forming substrate is less than the power required for atomising the same amount of liquid aerosol-forming substrate using known aerosol-generators, such as electric heaters.

Advantageously, the channel of the supply element of aerosol-generators according to the present disclosure facilitates improved control of the rate at which a liquid aerosol-forming substrate is supplied to the at least one atomisation region of the surface acoustic wave atomiser. In particular, the channel of the supply element facilitates improved control of the flow rate of a liquid aerosol-forming substrate when compared to known liquid transfer elements, such as capillary wicks. For example, one or more dimensions of the channel may be selected to provide a desired volumetric flow rate of liquid aerosol-forming substrate through the channel.

Advantageously, a variable cross-sectional area of the channel may facilitate providing both a desired flow rate of liquid aerosol-forming substrate through the channel and at least one of a desired size and shape of the channel at the outlet positioned within the at least one atomisation region. The desired size or shape of the channel at the outlet may be selected to increase or optimise the transfer of energy from surface acoustic waves generated by the surface acoustic wave atomiser to a liquid aerosol-forming substrate at the at least one atomisation region.

Advantageously, a portion of the channel that extends in a non-perpendicular direction with respect to the active surface may provide increased mechanical stability of the substrate at the outlet.

At least a portion of the channel may have a substantially linear cross-sectional shape. In embodiments in which the channel has a portion extending in a non-perpendicular direction with respect to the active surface, preferably the substantially linear portion of the channel extends in the non-perpendicular direction with respect to the active surface. Preferably, the substantially linear portion of the channel is inclined towards the at least one transducer.

In embodiments in which the channel has a cross-sectional area that varies in a direction from the inlet to the outlet, preferably, at least a portion of the channel has a cross-sectional area that increases in the direction from the inlet to the outlet. Advantageously, a channel having an increasing cross-sectional area in the direction from the inlet to the outlet may increase or optimise the transfer of energy from surface acoustic waves to a liquid aerosol-forming substrate at the at least one atomisation region. Preferably, the at least a portion of the channel having a cross-sectional area that increases in the direction from the inlet to the outlet is in the vicinity of the outlet.

The channel may comprise a first portion defining a minimum cross-sectional area of the channel to determine a flow rate of liquid aerosol-forming substrate through the channel. Preferably, the first portion extends from the inlet. The channel may comprise a second portion having a different cross-sectional area compared to the first portion. Preferably, the second portion has a larger cross-sectional area than the first portion. Preferably, the second portion extends between the first portion and the outlet. Preferably, the second portion has a cross-sectional area that increases in the direction from the inlet to the outlet.

At least a portion of the channel may have a funnel shape, a conical shape, or a wedge shape. Preferably, the at least a portion of the channel having a funnel shape, a conical shape, or a wedge shape is in the vicinity of the outlet.

In embodiments in which at least a portion of the channel has a funnel shape, the funnel shape may comprise a first portion having a substantially constant cross-sectional area extending from the inlet and a second portion extending between the first portion and the outlet, wherein the second portion has a cross-sectional area that increases in the direction from the inlet to the outlet. The second portion may have a conical shape. The second portion may have a truncated conical shape. The conical shape of the second portion may be a straight-sided conical shape. The conical shape of the second portion may be a curved-sided conical shape.

In embodiments in which at least a portion of the channel has a conical shape, the conical shape may be a truncated conical shape. The truncated end of the conical shape may define the inlet. The conical shape may be a straight-sided conical shape. The conical shape may be a curved-sided conical shape.

Preferably, at least a portion of the channel is curved. Advantageously, a curved portion of the channel may facilitate the transfer of energy from surface acoustic waves to a liquid aerosol-forming substrate at the at least one atomisation region.

Preferably, at least a portion of the channel at the outlet is curved to form a continuous transition between the channel and the active surface of the substrate.

Preferably, at least a portion of the channel at the outlet extends tangentially with respect to the active surface of the substrate. Advantageously, a tangentially extending portion of the channel at the outlet may facilitate the formation of a thin film of a liquid aerosol-forming substrate in the at least one atomisation region at the active surface of the substrate. Advantageously, a thin film of liquid aerosol-forming substrate facilitates aerosolisation of the liquid aerosol-forming substrate by the surface acoustic waves generated by the surface acoustic wave atomiser.

The outlet may comprise a first side and a second side opposite the first side, wherein the first side is positioned between the second side and the at least one transducer. The channel may comprise a first outlet portion at the first side of the outlet and a second outlet portion at the second side of the outlet, wherein the first outlet portion extends tangentially with respect to the active surface, and wherein the second outlet portion extends perpendicularly with respect to the active surface.

Advantageously, a first outlet portion extending tangentially with respect to the active surface may increase or optimise the transfer of energy from surface acoustic waves to a liquid aerosol-forming substrate at the at least one atomisation region.

Advantageously, a first outlet portion extending tangentially with respect to the active surface may facilitate the formation of a thin film of a liquid aerosol-forming substrate in the at least one atomisation region at the active surface of the substrate. Advantageously, a thin film of liquid aerosol-forming substrate facilitates aerosolisation of the liquid aerosol-forming substrate by the surface acoustic waves generated by the surface acoustic wave atomiser.

Advantageously, a second outlet portion extending perpendicularly with respect to the active surface may function as a reflector to reflect surface acoustic waves towards the at least one atomisation region. Advantageously, reflecting surface acoustic waves towards the at least one atomisation region may reduce or minimise the required power input for the at least one transducer. In other words, using a reflector to reflect surface acoustic waves towards the at least one atomisation region may increase the efficiency of the surface acoustic wave atomiser.

The substrate may define a recess at the active surface of the substrate. Preferably, the recess extends between the at least one transducer and the outlet. Preferably, the at least one transducer and the outlet are both positioned within the recess. The substrate may comprise a wall at least partially defining the recess, wherein the wall extends perpendicularly with respect to the active surface. Preferably, the wall is positioned to reflect surface acoustic waves from the at least one transducer towards the outlet.

Preferably, the channel has a minimum cross-sectional area. The term "minimum cross-sectional area" is used herein to refer to the narrowest portion of the channel. The minimum cross-sectional area of the channel at least partially determines a flow rate of a liquid aerosol-forming substrate along the channel. Preferably, the channel has a minimum cross-sectional area of at least about $8\times10^{-3}$ square millimetres.

The supply element may comprise a single channel. In other words, the channel may be the only channel of the supply element.

The supply element may comprise a plurality of channels. The channel may be a first channel, wherein the supply element comprises at least one additional channel extending through the substrate.

The inlet may be a first inlet and the outlet may be a first outlet, wherein the supply element comprises at least one additional inlet for receiving a supply of a liquid aerosol-forming substrate and at least one additional outlet positioned within the at least one atomisation region of the active surface of the substrate. Preferably, each of the at least one additional channels extends between one of the additional inlets and one of the additional outlets. Preferably, each of the at least one additional channels has a cross-sectional area that varies in a direction from the respective additional inlet to the respective additional outlet.

Each of the at least one additional channels may comprise any of the optional and preferred features described herein with respect to the first channel.

Each of the channel, the inlet, and the outlet may be formed in the substrate using any suitable manufacturing process. Suitable processes include mechanical drilling, mechanical grinding (for example, abrasive blasting using at least one of sand and water), laser ablation, laser drilling, etching (for example, reactive ion etching), and combinations thereof.

According to a second aspect of the present disclosure there is provided an aerosol-generator for an aerosol-generating device, the aerosol-generator comprising a surface acoustic wave atomiser and a supply element. The surface acoustic wave atomiser comprises a substrate comprising an active surface defining at least one atomisation region. The surface acoustic wave atomiser also comprises at least one transducer positioned on the active surface of the substrate for generating surface acoustic waves on the active surface of the substrate. The supply element is arranged to supply a liquid aerosol-forming substrate to the at least one atomisation region of the surface acoustic wave atomiser. The supply element comprises a plurality of interconnected channels extending through the substrate between at least one inlet for receiving a supply of at least one liquid aerosol-forming substrate and at least one outlet positioned within the at least one atomisation region of the active surface of the substrate.

Advantageously, atomising a liquid aerosol-forming substrate using a surface acoustic wave atomiser provides improved control of the atomisation process when compared to other known aerosol-generators, such as electric heaters. In other words, the surface acoustic wave atomiser of aerosol-generators according to the present disclosure provides reliable and consistent amounts of atomised liquid aerosol-forming substrate.

Advantageously, the power required by a surface acoustic wave atomiser for atomising a liquid aerosol-forming substrate is less than the power required for atomising the same amount of liquid aerosol-forming substrate using known aerosol-generators, such as electric heaters.

Advantageously, the plurality of interconnected channels of the supply element of aerosol-generators according to the present disclosure facilitates improved control of the rate at which a liquid aerosol-forming substrate is supplied to the at least one atomisation region of the surface acoustic wave atomiser. In particular, the plurality of interconnected channels of the supply element facilitates improved control of the flow rate of a liquid aerosol-forming substrate when compared to known liquid transfer elements, such as capillary wicks. For example, one or more dimensions of the plurality of interconnected channels may be selected to provide a desired volumetric flow rate of liquid aerosol-forming substrate through the plurality of interconnected channels.

Advantageously, the plurality of interconnected channels may facilitate supplying a single liquid aerosol-forming substrate to multiple outlets within the at least one atomisation region.

Advantageously, the plurality of interconnected channels may facilitate mixing of two or more liquid aerosol-forming substrates by the supply element. Advantageously, mixing of two or more liquid aerosol-forming substrates by the supply element enables providing a mixed liquid aerosol-forming substrates to the at least one atomisation region. Advantageously, mixing of two or more liquid aerosol-forming substrates by the supply element facilitates separately storing two or more liquid aerosol-forming substrates and mixing the two or more liquid aerosol-forming substrates only during use.

The at least one inlet may comprise a single inlet and the at least one outlet may comprise a plurality of outlets, wherein the plurality of interconnected channels provides fluid communication between the inlet and each of the plurality of outlets. Advantageously, the single inlet and the plurality of outlets may facilitate supplying a single liquid aerosol-forming substrate to multiple locations within the at least one atomisation region. Advantageously, the plurality of outlets may facilitate a homogenous distribution of a liquid aerosol-forming substrate across the at least one atomisation region.

The plurality of outlets may comprise at least two outlets, at least three outlets, at least four outlets, or at least five outlets.

The plurality of outlets may comprise 20 outlets or fewer, 18 outlets or fewer, 16 outlets or fewer, 14 outlets of fewer, twelve outlets or fewer, or ten outlets or fewer.

The plurality of outlets may be positioned in the at least one atomisation region with any suitable arrangement.

The plurality of outlets may be positioned randomly within the at least one atomisation region.

The plurality of outlets may be arranged in a pattern within the at least one atomisation region. The plurality of outlets may be arranged symmetrically within the at least one atomisation region. The plurality of outlets may be arranged in one or more lines. The plurality of outlets may be arranged in at least one of a grid, a spiral, and one or more concentric circles.

The at least one outlet may comprise a single outlet and the at least one inlet may comprise a plurality of inlets, wherein the plurality of interconnected channels provides fluid communication between the outlet and each of the plurality of inlets. Advantageously, the single outlet and the plurality of inlets may facilitate mixing of two or more liquid aerosol-forming substrates by the plurality of interconnected channels.

The plurality of inlets may comprise at least two inlets, at least three inlets, at least four inlets, or at least five inlets.

The plurality of inlets may comprise 20 inlets or fewer, 18 inlets or fewer, 16 inlets or fewer, 14 inlets of fewer, twelve inlets or fewer, or ten inlets or fewer.

The plurality of inlets may be positioned on a surface of the substrate with any suitable arrangement.

The plurality of inlets may be positioned randomly on a surface of the substrate.

The plurality of inlets may be arranged in a pattern on a surface of the substrate. The plurality of inlets may be arranged symmetrically on a surface of the substrate. The plurality of inlets may be arranged in one or more lines. The plurality of inlets may be arranged in at least one of a grid, a spiral, and one or more concentric circles.

Preferably, each of the at least one inlets has a cross-sectional area of at least about $8\times10^{-3}$ square millimetres.

Each of the at least one inlet, the at least one outlet, and the plurality of interconnected channels may be formed in the substrate using any suitable manufacturing process. Suitable processes include mechanical drilling, mechanical grinding, laser ablation, laser drilling, etching (for example, reactive ion etching), and combinations thereof.

According to a third aspect of the present disclosure there is provided an aerosol-generator for an aerosol-generating device, the aerosol-generator comprising a surface acoustic wave atomiser and a supply element. The surface acoustic wave atomiser comprises a substrate comprising an active surface defining at least one atomisation region. The surface acoustic wave atomiser also comprises at least one transducer positioned on the active surface of the substrate for generating surface acoustic waves on the active surface of the substrate. The supply element is arranged to supply a liquid aerosol-forming substrate to the at least one atomisation region of the surface acoustic wave atomiser. The supply element comprises at least one channel extending through the substrate between at least one inlet for receiving a supply of a liquid aerosol-forming substrate and at least one outlet positioned within the at least one atomisation region of the active surface of the substrate. The substrate is a laminate material comprising a plurality of layers of substrate material. At least one of the layers of substrate material defines the at least one outlet, at least one of the layers of substrate material defines the at least one inlet, and at least one of the layers of substrate material defines the at least one channel.

Advantageously, forming the substrate from a plurality of layers of substrate material defining the at least one inlet, the at least one outlet and the at least one channel may facilitate the formation of a channel having a non-linear shape.

Preferably, at least two of the layers of substrate material define the at least one channel. Advantageously, defining the at least one channel with multiple layers of substrate material may further facilitate the formation of a channel having a non-linear shape. Preferably, the at least two layers of substrate material comprises a first layer of substrate material defining a first portion of the at least one channel and a second layer of substrate material defining a second portion of the at least one channel.

The plurality of layers of substrate material may be secured together by at least one of bonding, clamping, and one or more adhesives.

The aerosol generator according to the third aspect of the present disclosure may be an aerosol-generator according to the first aspect of the present disclosure or the second aspect of the present disclosure.

The following preferred and optional features of the aerosol generator may be applied to aerosol generators according to the first, second and third aspects of the present disclosure.

The at least one transducer may comprise an interdigital transducer comprising a plurality of electrodes. Preferably, the plurality of electrodes are substantially parallel with each other. Preferably, the interdigital transducer comprises a first array of electrodes and a second array of electrodes interleaved with the first array of electrodes. Preferably, the first array of electrodes is substantially parallel with the second array of electrodes.

The transducer may be configured to generate surface acoustic waves having a substantially linear wavefront. In embodiments in which the transducer is an interdigital transducer comprising a plurality of electrodes, each electrode may be substantially linear.

The transducer may be configured to generate surface acoustic waves having a curved wavefront. In embodiments in which the transducer is an interdigital transducer comprising a plurality of electrodes, each electrode may be curved. The transducer may be configured to generate surface acoustic waves having a convex wavefront. Preferably, the transducer may be configured to generate surface acoustic waves having a concave wavefront. Advantageously, a concave wavefront may provide a focussing effect. In other words, a concave wavefront may focus the generated surface acoustic waves towards an atomisation region that is smaller than the transducer. Advantageously, focussing the generated surface acoustic waves may increase the rate at which energy is delivered to a liquid aerosol-forming substrate in the atomisation region.

The at least one transducer may be a single transducer. The at least one transducer may be a plurality of transducers. In embodiments in which the surface acoustic wave atomiser comprises a plurality of transducers, preferably each transducer is arranged on the active surface of the substrate so that surface acoustic waves generated by the transducer travel towards the at least one atomisation region.

The surface acoustic wave atomiser may comprise at least one reflector. Preferably, the at least one reflector is positioned on the active surface of the substrate. Preferably, the at least one reflector is arranged to reflect surface acoustic waves from the at least one transducer towards the at least one atomisation region. Advantageously, a reflector arranged to reflect surface acoustic waves towards the at least one atomisation region may increase or maximise the efficiency of the surface acoustic wave atomiser.

The at least one reflector may comprise one or more electrodes.

The at least one reflector may comprise one or more portions of metal positioned on the active surface of the substrate. Each portion of metal may have a linear shape. Each portion of metal may have a curved shape. The at least one reflector may comprise a plurality of portions of metal. The plurality of portions of metal may be arranged in a pattern on the active surface of the substrate. Preferably, each portion of metal is substantially parallel to the adjacent portions of metal forming the at least one reflector.

A portion of the substrate may form at least part of the at least one reflector. The substrate may define at least one protrusion, wherein the at least one protrusion forms at least part of the at least one reflector. The substrate may define at least one recess, wherein the at least one recess forms at least part of the at least one reflector.

The at least one atomisation region may be positioned between the at least one transducer and the at least one reflector.

The at least one reflector may be a single reflector. The at least one reflector may be a plurality of reflectors.

In embodiments in which the surface acoustic wave atomiser comprises a plurality of transducers, the at least one reflector may be a plurality of reflectors. Each of the transducers may be positioned opposite one of the reflectors so that the at least one atomisation region is positioned between the transducer and the corresponding reflector.

The substrate is formed from a substrate material. The substrate may be a piezoelectric material. The substrate material may comprise a monocrystalline material. The substrate material may comprise a polycrystalline material. The substrate material may comprise at least one of quartz, a ceramic, barium titanate ($BaTiO_3$), and lithium niobate ($LiNbO_3$). The ceramic may comprise lead zirconate titanate (PZT). The ceramic may include doping materials such as Ni, Bi, La, Nd or Nb ions. The substrate material may be polarised. The substrate material may be unpolarised. The substrate material may comprise both polarised and unpolarised materials.

The substrate may comprise a surface treatment. The surface treatment may be applied to the active surface of the substrate. The surface treatment may comprise a coating. The coating may comprise a hydrophobic material. The coating may comprise a hydrophilic material. The coating may comprise an oleophobic material. The coating may comprise an oleophilic material.

According to a fourth aspect of the present disclosure there is provided an aerosol-generating device comprising an aerosol generator according to the first aspect of the present disclosure, the second aspect of the present disclosure, or the third aspect of the present disclosure. The aerosol-generating device also comprises a controller for controlling the at least one transducer, a power supply, and at least one liquid storage portion for receiving a liquid aerosol-forming substrate, wherein the supply element is arranged to supply liquid aerosol-forming substrate from the at least one liquid storage portion to the at least one atomisation region.

The at least one liquid storage portion may be reusable. In other words, the at least one liquid storage portion may be refillable by a user to replenish a liquid aerosol-forming substrate in the at least one liquid storage portion. The at least one liquid storage portion may comprise a refill aperture for inserting a liquid aerosol-forming substrate into the liquid storage portion. The at least one liquid storage portion may comprise a refill valve between the refill aperture and the at least one liquid storage portion. Advantageously, the refill valve may allow a liquid aerosol-forming substrate to flow through the refill aperture into the at least one liquid storage portion. Advantageously, the refill valve may prevent a liquid aerosol-forming substrate from flowing out of the at least one liquid storage portion through the refill aperture.

The at least one liquid storage portion may be replaceable. The at least one liquid storage portion may be removable from the aerosol-generating device. The aerosol-generating device may comprise a cartridge, wherein the cartridge is removable from the aerosol-generating device, and wherein the cartridge comprises the at least one liquid storage portion.

The aerosol-generating device may comprise a liquid aerosol-forming substrate contained within the at least one liquid storage portion.

The liquid aerosol-forming substrate may comprise nicotine. The nicotine containing liquid aerosol-forming substrate may be a nicotine salt matrix. The liquid aerosol-forming substrate may comprise plant-based material. The liquid aerosol-forming substrate may comprise tobacco. The liquid aerosol-forming substrate may comprise homogenised tobacco material. The liquid aerosol-forming substrate may comprise a non-tobacco-containing material. The liquid aerosol-forming substrate may comprise homogenised plant-based material.

The liquid aerosol-forming substrate may comprise at least one aerosol-former. An aerosol-former is any suitable known compound or mixture of compounds that, in use, facilitates formation of a dense and stable aerosol. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Aerosol formers may be polyhydric alcohols or mixtures thereof, such as triethylene glycol, 1,3-butanediol and glycerine. The liquid aerosol-forming substrate may comprise other additives and ingredients, such as flavourants.

The liquid aerosol-forming substrate may comprise water.

The liquid aerosol-forming substrate may comprise nicotine and at least one aerosol former. The aerosol former may comprise glycerine. The aerosol-former may comprise propylene glycol. The aerosol former may comprise both glycerine and propylene glycol. The liquid aerosol-forming substrate may have a nicotine concentration of between about 0.1 percent and about 10 percent.

In embodiments in which the inlet of the supply element comprises a plurality of inlets, the at least one liquid storage portion may comprise a first liquid storage portion and a second liquid storage portion. The first liquid storage portion is for receiving a first liquid aerosol-forming substrate, wherein the first liquid storage portion is in fluid communication with a first inlet of the plurality of inlets. The second liquid storage portion is for receiving a second liquid aerosol-forming substrate, wherein the second liquid storage portion is in fluid communication with a second inlet of the plurality of inlets.

The aerosol-generating device may comprise a flow control element arranged to control a flow rate of liquid aerosol-forming substrate from the at least one liquid storage portion to the channel of the supply element.

The flow control element may comprise at least one passive element. The at least one passive element may comprise at least one of a capillary tube and a capillary wick.

The flow control element may comprise at least one active element. The at least one active element may comprise at least one of a micro pump, a syringe pump, a piston pump, and an electroosmotic pump. Preferably, the controller is arranged to provide a control signal to the at least one active element to control a flow rate of liquid aerosol-forming substrate from the at least one liquid storage portion to the channel of the supply element.

The controller may comprise electric circuitry connected to the power supply and the at least one transducer. The electric circuitry may comprise a microprocessor. The microprocessor may be a programmable microprocessor, a microcontroller, or an application specific integrated chip (ASIC) or other electronic circuitry capable of providing control. The electric circuitry may comprise further electronic components. The electric circuitry may be configured to regulate a supply of power from the power supply to the at least one transducer. The controller may be configured to supply power continuously to the at least one transducer following activation of the aerosol-generative device. The controller may be configured to supply power intermittently to the at least one transducer. The controller may be configured to supply power to the at least one transducer on a puff-by-puff basis.

Preferably, the controller and the power supply are configured to provide an alternating voltage to the at least one transducer. Preferably, the alternating voltage is a radio frequency alternating voltage. Preferably, the alternating voltage has a frequency of at least about 20 megahertz. Preferably, the alternating voltage has a frequency of between about 20 megahertz and about 100 megahertz, more preferably between about 20 megahertz and about 80 megahertz. Advantageously, an alternating voltage within these ranges may provide at least one of a desired rate of aerosol generating and a desired droplet size.

The power supply may be any suitable type of power supply. The power supply may be a DC power supply. In some preferred embodiments, the power supply is a battery, such as a rechargeable lithium ion battery. The power supply may be another form of charge storage device, such as a capacitor. The power supply may require recharging. The power supply may have a capacity that allows for the storage of enough energy for one or more uses of the device. For example, the power supply may have sufficient capacity to allow for the continuous generation of aerosol for a period of around six minutes, corresponding to the typical time taken to smoke a conventional cigarette, or for a period that is a multiple of six minutes. In another example, the power supply may have sufficient capacity to allow for a predetermined number of uses of the device or discrete activations. In one embodiment, the power supply is a DC power supply having a DC supply voltage in the range of about 2.5 Volts to about 4.5 Volts and a DC supply current in the range of about 1 Amp to about 10 Amps (corresponding to a DC power supply in the range of about 2.5 Watts to about 45 Watts).

The aerosol-generating device may advantageously comprise a DC/AC inverter, which may comprise a Class-C, Class-D or Class-E power amplifier. The DC/AC inverter may be arranged between the power supply and the at least one transducer.

The aerosol-generating device may further comprise a DC/DC converter between the power supply and the DC/AC inverter.

The aerosol-generating device may comprise a device housing. The device housing may be elongate. The device housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and non-brittle.

The device housing may define an air inlet. The air inlet may be configured to enable ambient air to enter the device housing. The air inlet may be in fluid communication with the at least one atomisation region of the aerosol generator. The device may comprise any suitable number of air inlets. The device may comprise a plurality of air inlets.

The device housing may comprise an air outlet. The air outlet may be configured to enable air to exit the device housing for delivery to a user. The air outlet may be in fluid communication with the at least one atomisation region of the aerosol generator. The aerosol-generating device may comprise a mouthpiece. The mouthpiece may comprise the air outlet. The device may comprise any suitable number of air outlets. The device may comprise a plurality of air outlets.

The invention will be further described, by way of example only, with reference to the accompanying drawings, in which.

Figure 1:
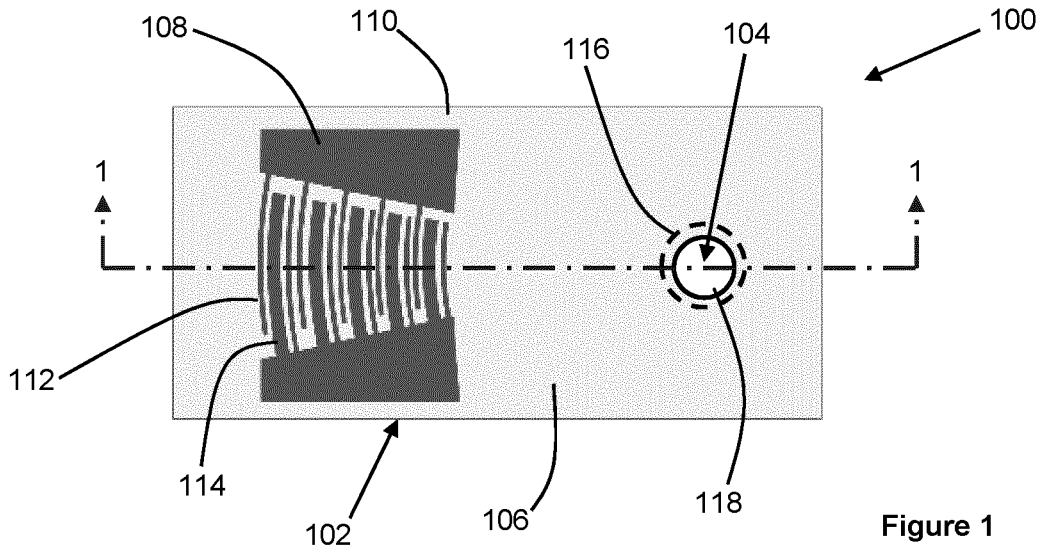
FIG. 1 shows a top view of an aerosol-generator according to a first embodiment of the present disclosure.
Figure 2:
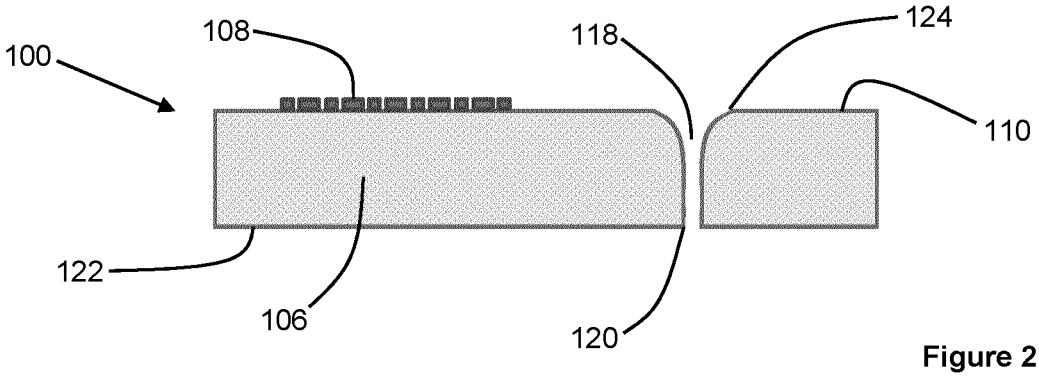
FIG. 2 shows a cross-sectional view of the aerosol-generator of FIG. 1 taken along line 1-1.

FIGS. 1 and 2 show an aerosol-generator 100 according to a first embodiment of the present disclosure. The aerosol-generator 100 comprises a surface acoustic wave atomiser 102 and a supply element 104 for supplying a liquid aerosol-forming substrate to the surface acoustic wave atomiser 102.

The surface acoustic wave atomiser 102 comprises a substrate 106 comprising a sheet of piezoelectric material, and a transducer 108 arranged on an active surface 110 of the substrate 106. The transducer 108 comprises a first array of electrodes 112 and a second array of electrodes 114 interleaved with the first array of electrodes 112. The first and second arrays of electrodes 112, 114 are curved and parallel with each other. During use, the transducer 108 generates surface acoustic waves on the active surface 110 of the substrate 106. The curved shape of the first and second arrays of electrodes 112, 114 results in surface acoustic waves having a concave wavefront focussed towards an atomisation region 116 on the active surface 110 of the substrate 106.

The supply element 104 comprises a channel 118 extending through the substrate 106 between an inlet 120 at a passive surface 122 of the substrate 106 and an outlet 124 at the active surface 110 of the substrate 106. The outlet 124 is positioned within the atomisation region 116. During use, a liquid aerosol-forming substrate is supplied through the channel 118 to the atomisation region 116 where it is atomised by surface acoustic waves generated by the transducer 108.

Figure 3:
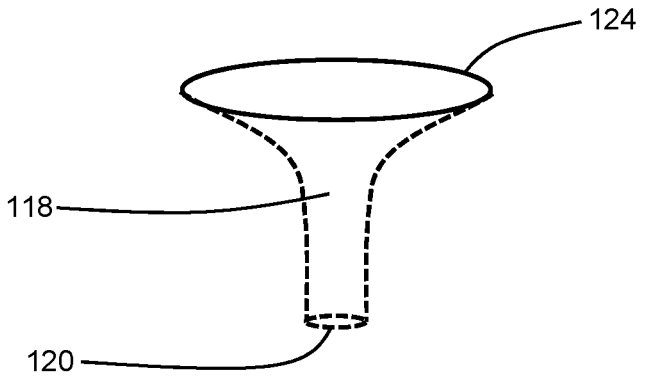
FIG. 3 shows a perspective view of the channel of the aerosol-generator of FIG. 1.

As shown in FIG. 3, which shows a perspective view of the channel 118, the channel 118 has a cross-sectional area that varies in a direction from the inlet 120 to the outlet 124. In particular, the channel 118 has a funnel shape so that the cross-sectional area of the channel 118 increases in the direction from the inlet 120 to the outlet 124. The smaller cross-sectional area of the channel 118 at the inlet 120 facilitates control of the flow rate of liquid aerosol-forming substrate into the channel 118. The larger cross-sectional area of the channel 118 at the outlet 124 provides a larger surface area of liquid aerosol-forming substrate at the atomisation region 116 to facilitate atomisation of the liquid aerosol-forming substrate. The curved transition at the inlet 120 between the active surface 110 and the channel 118 facilitates the transfer of energy from the surface acoustic waves to the liquid aerosol-forming substrate.

Figure 4:
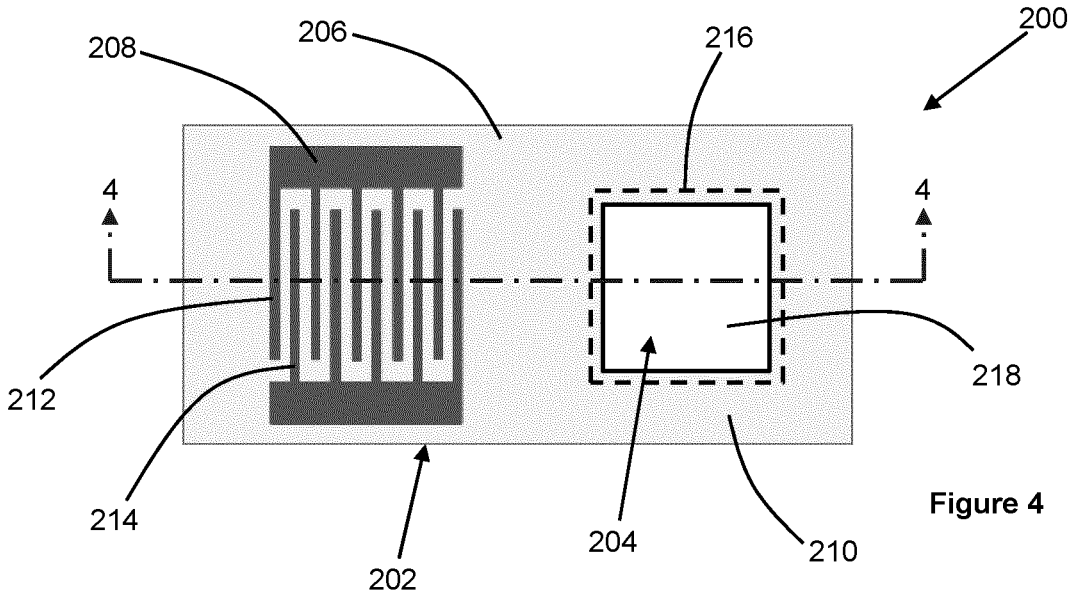
FIG. 4 shows a top view of an aerosol-generator according to a second embodiment of the present disclosure.
Figure 5:
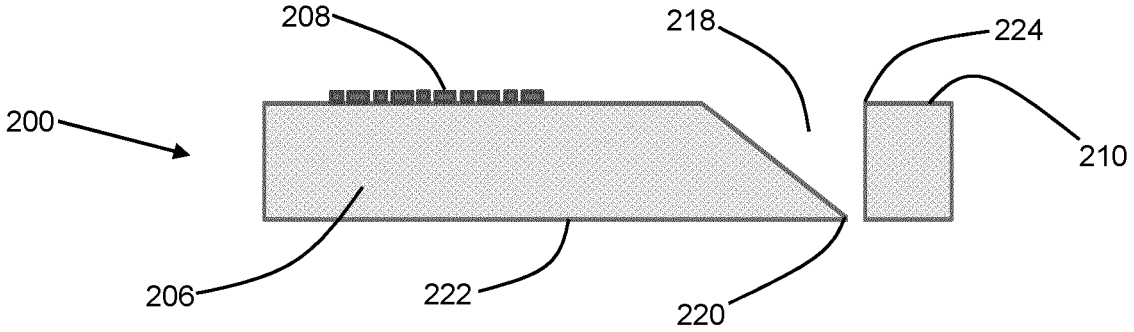
FIG. 5 shows a cross-sectional view of the aerosol-generator of FIG. 4 taken along line 4-4.

FIGS. 4 and 5 show an aerosol-generator 200 according to a second embodiment of the present disclosure. The aerosol-generator 200 comprises a surface acoustic wave atomiser 202 and a supply element 204 for supplying a liquid aerosol-forming substrate to the surface acoustic wave atomiser 202.

The surface acoustic wave atomiser 202 comprises a substrate 206 comprising a sheet of piezoelectric material, and a transducer 208 arranged on an active surface 210 of the substrate 206. The transducer 208 comprises a first array of electrodes 212 and a second array of electrodes 214 interleaved with the first array of electrodes 212. The first and second arrays of electrodes 212, 214 are linear and parallel with each other. During use, the transducer 208 generates surface acoustic waves on the active surface 210 of the substrate 206. The linear shape of the first and second arrays of electrodes 212, 214 results in surface acoustic waves having a linear wavefront directed towards an atomisation region 216 on the active surface 210 of the substrate 206.

The supply element 204 comprises a channel 218 extending through the substrate 206 between an inlet 220 at a passive surface 222 of the substrate 206 and an outlet 224 at the active surface 210 of the substrate 206. The outlet 224 is positioned within the atomisation region 216. During use, a liquid aerosol-forming substrate is supplied through the channel 218 to the atomisation region 216 where it is atomised by surface acoustic waves generated by the transducer 208.

Figure 6:
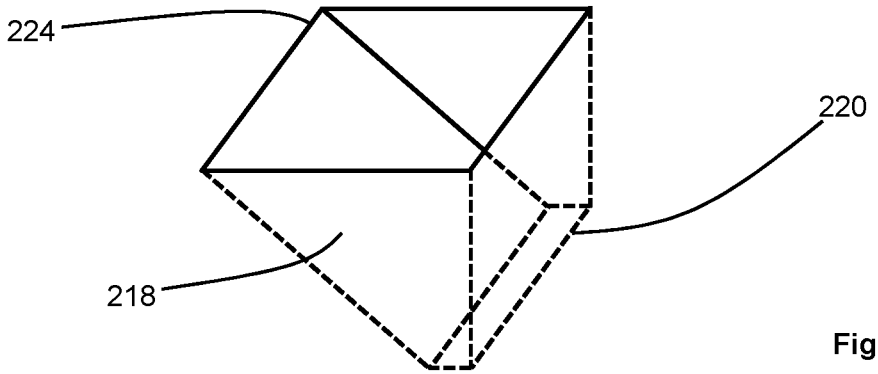
FIG. 6 shows a perspective view of the channel of the aerosol-generator of FIG. 4.

As shown in FIG. 6, which shows a perspective view of the channel 218, the channel 218 has a cross-sectional area that varies in a direction from the inlet 220 to the outlet 224. In particular, the channel 218 has a wedge shape so that the cross-sectional area of the channel 218 increases in the direction from the inlet 220 to the outlet 224. The smaller cross-sectional area of the channel 218 at the inlet 220 facilitates control of the flow rate of liquid aerosol-forming substrate into the channel 218. The larger cross-sectional area of the channel 218 at the outlet 224 provides a larger surface area of liquid aerosol-forming substrate at the atomisation region 216 to facilitate atomisation of the liquid aerosol-forming substrate.

Figure 7:
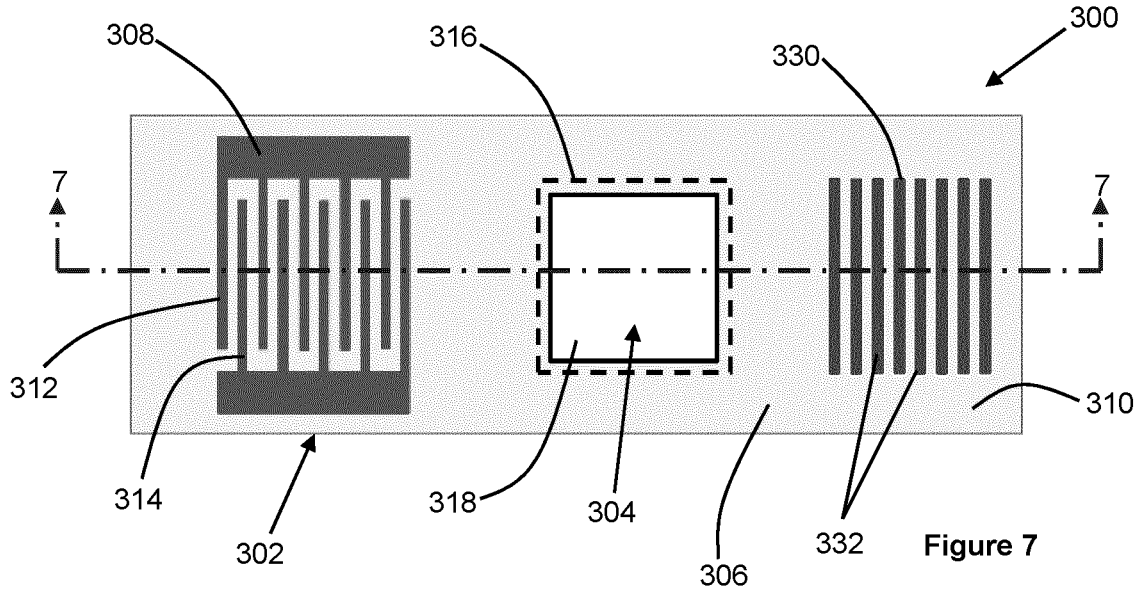
FIG. 7 shows a top view of an aerosol-generator according to a third embodiment of the present disclosure.
Figure 8:
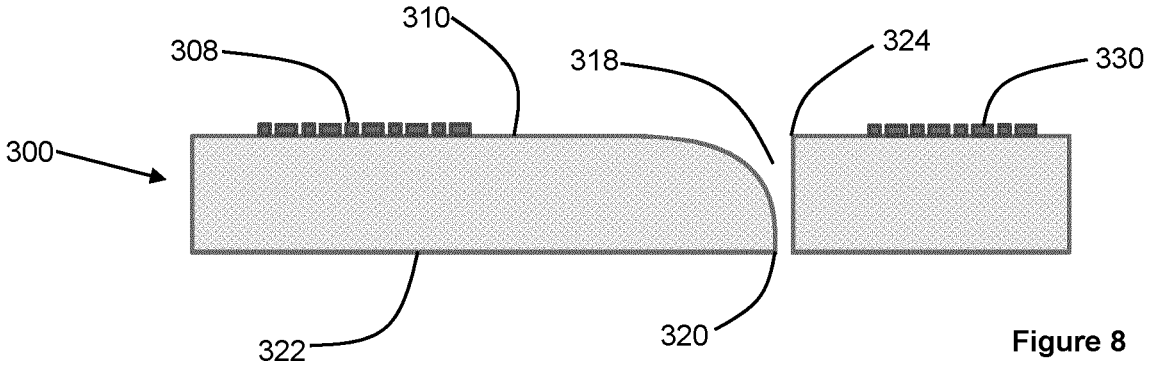
FIG. 8 shows a cross-sectional view of the aerosol-generator of FIG. 7 taken along line 7-7.

FIGS. 7 and 8 show an aerosol-generator 300 according to a third embodiment of the present disclosure. The aerosol-generator 300 comprises a surface acoustic wave atomiser 302 and a supply element 304 for supplying a liquid aerosol-forming substrate to the surface acoustic wave atomiser 302.

The surface acoustic wave atomiser 302 comprises a substrate 306 comprising a sheet of piezoelectric material, and a transducer 308 arranged on an active surface 310 of the substrate 306. The transducer 308 comprises a first array of electrodes 312 and a second array of electrodes 314 interleaved with the first array of electrodes 312. The first and second arrays of electrodes 312, 314 are linear and parallel with each other. During use, the transducer 308 generates surface acoustic waves on the active surface 310 of the substrate 306. The linear shape of the first and second arrays of electrodes 312, 314 results in surface acoustic waves having a linear wavefront directed towards an atomisation region 316 on the active surface 310 of the substrate 306.

The surface acoustic wave atomiser 302 also comprises a reflector 330 positioned on the active surface 310 of the substrate 306 so that the atomisation region 316 is positioned between the transducer 308 and the reflector 330. The reflector 330 comprises an array of reflector electrodes 332 each having a linear shape and arranged parallel with each other and the first and second arrays 312, 314 of electrodes of the transducer 308. During use, some of the surface acoustic waves generated by the transducer 308 may be transmitted entirely through the atomisation region 316. The reflector 330 functions to reflect any transmitted surface acoustic waves back towards the atomisation region 316.

The supply element 304 comprises a channel 318 extending through the substrate 306 between an inlet 320 at a passive surface 322 of the substrate 306 and an outlet 324 at the active surface 310 of the substrate 306. The outlet 324 is positioned within the atomisation region 316. During use, a liquid aerosol-forming substrate is supplied through the channel 318 to the atomisation region 316 where it is atomised by surface acoustic waves generated by the transducer 308.

Figure 9:
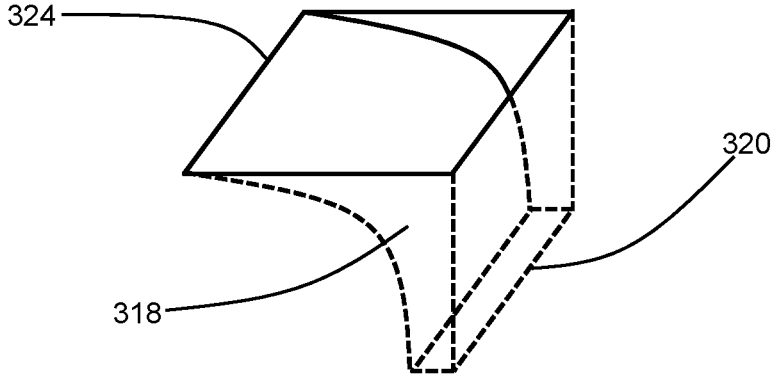
FIG. 9 shows a perspective view of the channel of the aerosol-generator of FIG. 7.

As shown in FIG. 9, which shows a perspective view of the channel 318, the channel 318 has a cross-sectional area that varies in a direction from the inlet 320 to the outlet 324. In particular, the channel 318 has a curved wedge shape so that the cross-sectional area of the channel 318 increases in the direction from the inlet 320 to the outlet 324. The smaller cross-sectional area of the channel 318 at the inlet 320 facilitates control of the flow rate of liquid aerosol-forming substrate into the channel 318. The larger cross-sectional area of the channel 318 at the outlet 324 provides a larger surface area of liquid aerosol-forming substrate at the atomisation region 316 to facilitate atomisation of the liquid aerosol-forming substrate. The curved transition at the inlet 320 between the active surface 310 and the channel 318 at the side of the channel 318 closest to the transducer 308 facilitates the transfer of energy from the surface acoustic waves to the liquid aerosol-forming substrate.

Figure 10:
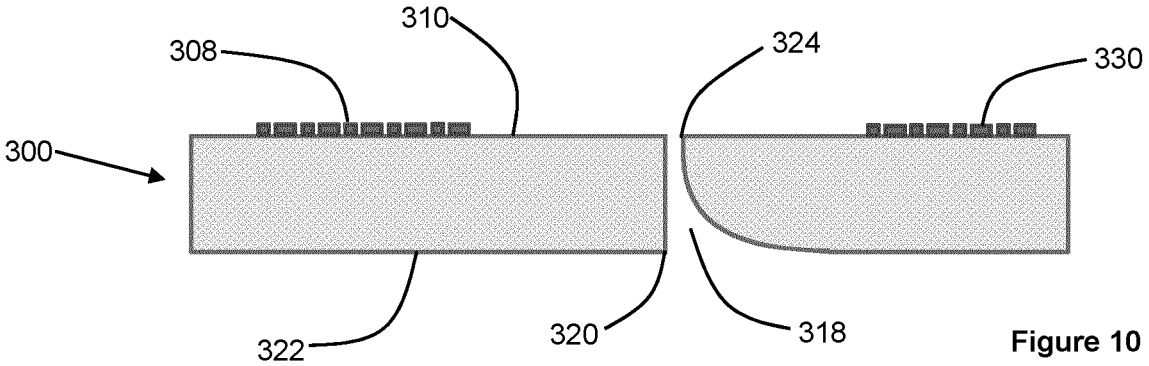
FIG. 10 shows a first variation of the aerosol-generator of FIG. 8.

FIG. 10 shows a first variation of the aerosol-generator 300 of FIGS. 7 and 8. In the first variation shown in FIG. 10, the channel 318 has a cross-sectional shape that decreases in the direction from the inlet 320 to the outlet 324.

Figure 11:
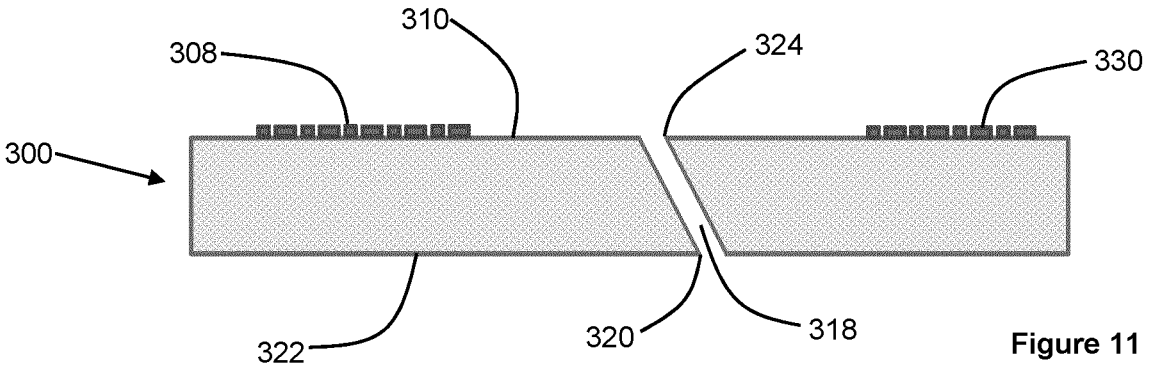
FIG. 11 shows a second variation of the aerosol-generator of FIG. 8.

FIG. 11 shows a second variation of the aerosol-generator 300 of FIGS. 7 and 8. In the second variation shown in FIG. 11, the channel 318 extends in a non-perpendicular direction with respect to the active surface 310. In particular, the channel 318 has a substantially linear cross-sectional shape and is inclined towards the transducer 308. Advantageously, inclining the channel 318 towards the transducer 308 facilitates the transfer of energy from the surface acoustic waves to the liquid aerosol-forming substrate and increases the mechanical stability of the substrate 306 at the outlet 324.

Figure 12:
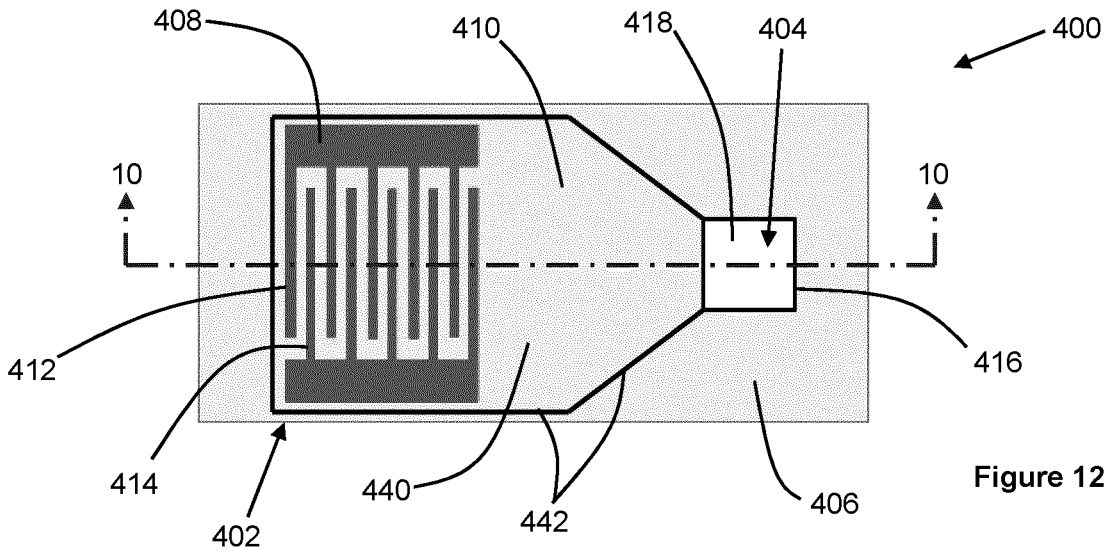
FIG. 12 shows a top view of an aerosol-generator according to a fourth embodiment of the present disclosure.
Figure 13:
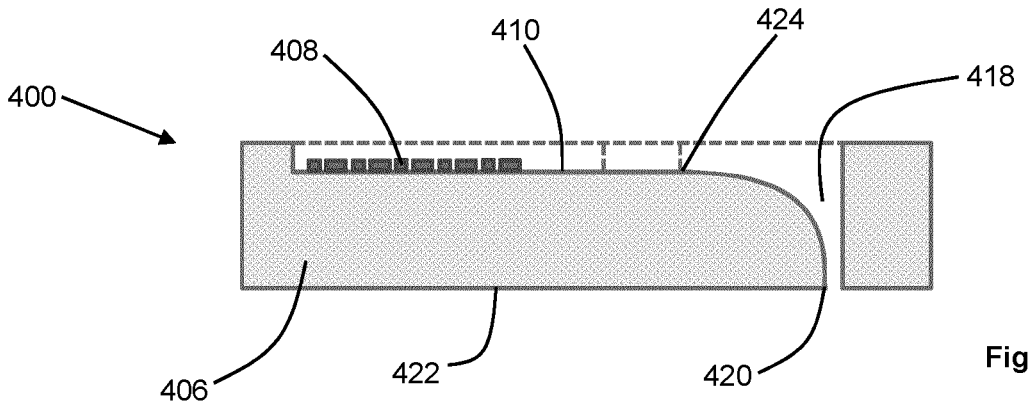
FIG. 13 shows a cross-sectional view of the aerosol-generator of FIG. 12 taken along line 10-10.
Figure 14:
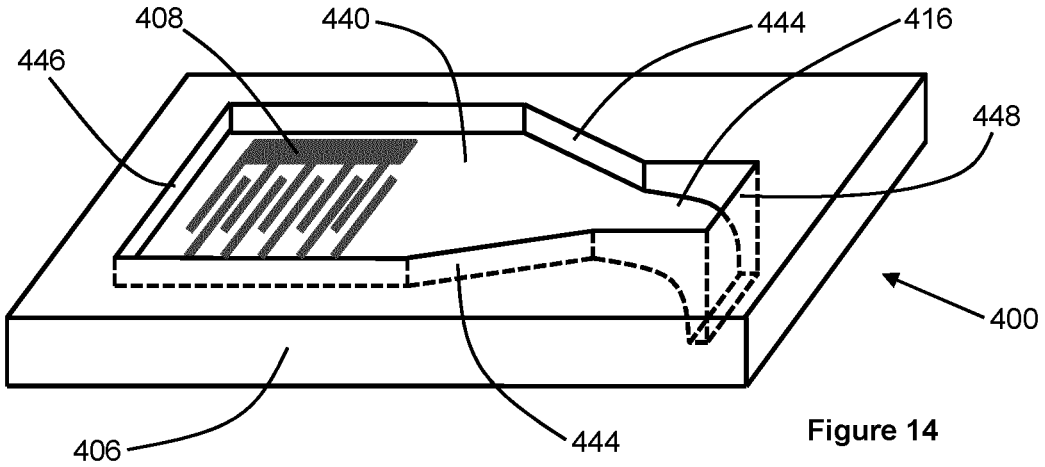
FIG. 14 shows a perspective view of the aerosol-generator of FIG. 12.

FIGS. 12, 13 and 14 show an aerosol-generator 400 according to a fourth embodiment of the present disclosure. The aerosol-generator 400 comprises a surface acoustic wave atomiser 402 and a supply element 404 for supplying a liquid aerosol-forming substrate to the surface acoustic wave atomiser 402.

The surface acoustic wave atomiser 402 comprises a substrate 406 comprising a sheet of piezoelectric material, and a transducer 408. The substrate 406 comprises a plurality of walls 442 defining a recess 440 in a surface of the substrate 406. The transducer 408 is arranged on an active surface 410 of the substrate 406 within the recess 440.

The transducer 408 comprises a first array of electrodes 412 and a second array of electrodes 414 interleaved with the first array of electrodes 412. The first and second arrays of electrodes 412, 414 are linear and parallel with each other. During use, the transducer 408 generates surface acoustic waves on the active surface 410 of the substrate 406. The linear shape of the first and second arrays of electrodes 412, 414 results in surface acoustic waves having a linear wavefront directed towards an atomisation region 416 on the active surface 410 of the substrate 406.

The supply element 404 comprises a channel 418 extending through the substrate 406 between an inlet 420 at a passive surface 422 of the substrate 406 and an outlet 424 at the active surface 410 of the substrate 406. The outlet 424 is positioned within the recess 440 and the atomisation region 416. During use, a liquid aerosol-forming substrate is supplied through the channel 418 to the atomisation region 416 where it is atomised by surface acoustic waves generated by the transducer 408.

As shown in FIG. 9, which shows a perspective view of the aerosol-generator 400, the channel 418 has a cross-sectional area that varies in a direction from the inlet 420 to the outlet 424. In particular, the channel 418 has a curved wedge shape so that the cross-sectional area of the channel 418 increases in the direction from the inlet 420 to the outlet 424. The smaller cross-sectional area of the channel 418 at the inlet 420 facilitates control of the flow rate of liquid aerosol-forming substrate into the channel 418. The larger cross-sectional area of the channel 418 at the outlet 424 provides a larger surface area of liquid aerosol-forming substrate at the atomisation region 416 to facilitate atomisation of the liquid aerosol-forming substrate. The curved transition at the inlet 420 between the active surface 410 and the channel 418 at the side of the channel 418 closest to the transducer 408 facilitates the transfer of energy from the surface acoustic waves to the liquid aerosol-forming substrate.

The plurality of walls 442 defining the recess 440 comprises a pair of angled walls 444 arranged to reflect surface acoustic waves generated by the transducer 408 towards the atomisation region 416. The plurality of walls 442 also comprises a back wall 446 arranged to reflect any surface acoustic waves propagating from the transducer 408 in a direction away from the atomisation region 416 back towards the atomisation region 416. The plurality of walls 442 also comprises a front wall 448 that partially defines the inlet 424 and is also arranged to reflect any surface acoustic waves that are transmitted entirely through the atomisation region 416 back into the atomisation region 416. Advantageously, the walls 444, 446 and 448 increase or maximise the energy transferred from the surface acoustic waves to liquid aerosol-forming substrate in the atomisation region 416.

Figure 15:
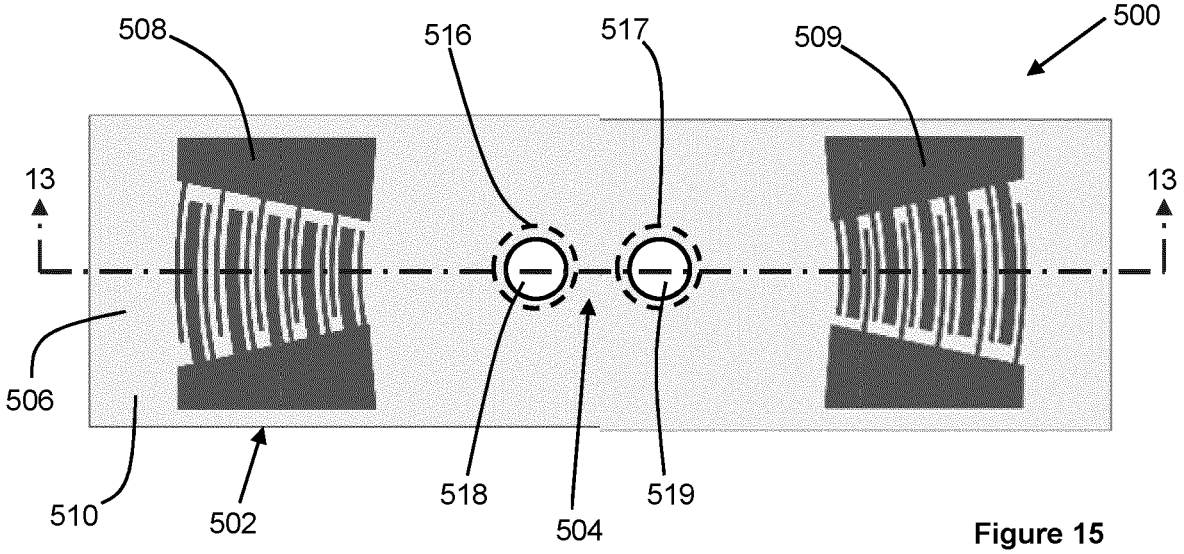
FIG. 15 shows a top view of an aerosol-generator according to a fifth embodiment of the present disclosure.
Figure 16:
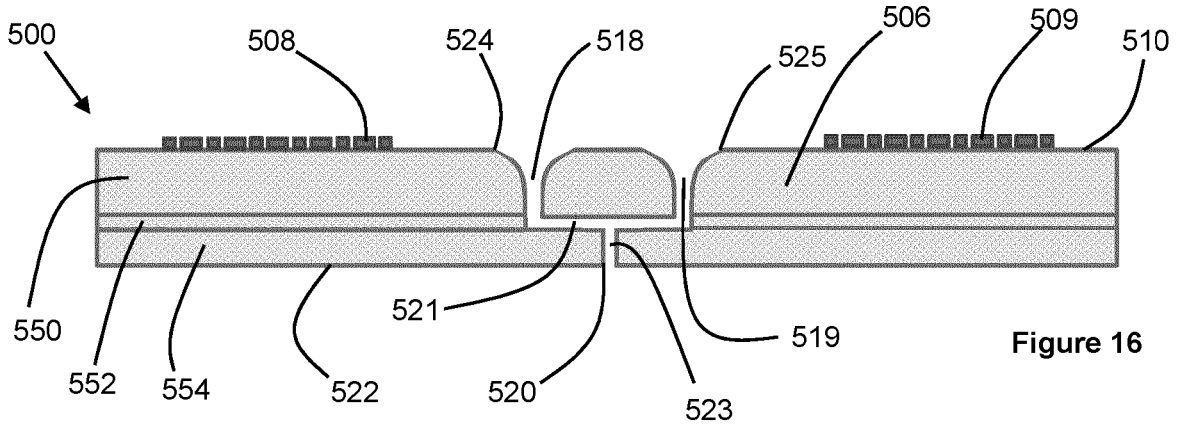
FIG. 16 shows a cross-sectional view of the aerosol-generator of FIG. 15 taken along line 13-13.

FIGS. 15 and 16 show an aerosol-generator 500 according to a fifth embodiment of the present disclosure. The aerosol-generator 500 comprises a surface acoustic wave atomiser 502 and a supply element 504 for supplying a liquid aerosol-forming substrate to the surface acoustic wave atomiser 502.

The surface acoustic wave atomiser 502 comprises a substrate 506 comprising a sheet of piezoelectric material, a first transducer 508 and a second transducer 509. The first and second transducers 508, 509 are arranged on an active surface 510 of the substrate 506.

Each of the first and second transducers 508, 509 comprises first and second arrays of electrodes as described with respect to the transducer 108 of FIG. 1. The first and second arrays of electrodes of each of the first and second transducers 508, 509 are curved and parallel with each other. During use, each of the first and second transducers 508, 509 generates surface acoustic waves on the active surface 510 of the substrate 506. The curved shape of the first and second arrays of electrodes of the first transducer 508 results in surface acoustic waves having a concave wavefront focussed towards a first atomisation region 516 on the active surface 510 of the substrate 506. The curved shape of the first and second arrays of electrodes of the second transducer 509 results in surface acoustic waves having a concave wavefront focussed towards a second atomisation region 517 on the active surface 510 of the substrate 506.

The supply element 504 comprises a plurality of interconnected channels extending through the substrate 506 between an inlet 520 at a passive surface 522 of the substrate 506 and first and second outlets 524, 525 at the active surface 510 of the substrate 506. The first outlet 524 is positioned within the first atomisation region 516 and the second outlet 525 is positioned within the second atomisation region 517.

The plurality of interconnected channels comprises an inlet channel 523, a transverse channel 521, a first outlet channel 518 and a second outlet channel 519. The inlet channel 523 extends from the inlet 520. The transverse channel 521 is in fluid communication with the inlet channel 523. The first outlet channel 518 extends between a first end of the transverse channel 521 and the first outlet 524. The second outlet channel 519 extends between a second end of the transverse channel 521 and the second outlet 525. During use, a liquid aerosol-forming substrate is supplied through the plurality of interconnected channels to the first atomisation region 516 and the second atomisation region 517 where it is atomised by surface acoustic waves generated by the first transducer 508 and the second transducer 509.

Figure 17:
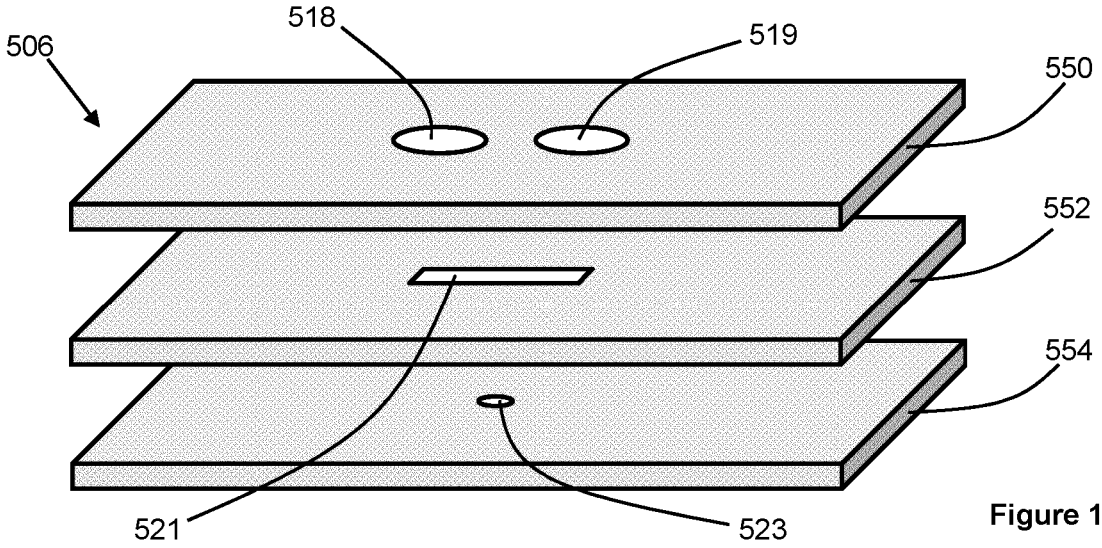
FIG. 17 shows an exploded perspective view of the substrate of the aerosol-generator of FIG. 15.

As shown in FIG. 17, which shows an exploded perspective view of the substrate 506, the substrate 506 is formed from a plurality of layers of substrate material to facilitate the formation of the plurality of interconnected channels. In particular, the substrate 506 comprises first, second and third layers 550, 552, 554 of substrate material. The first layer 550 of substrate material defines the first and second outlet channels 518, 519. The second layer 552 of substrate material defines the transverse channel 521. The third layer 554 of substrate material defines the inlet channel 523. The first, second and third layers 550, 522, 524 of substrate material are adhered together to form the substrate 506.

Figure 18:
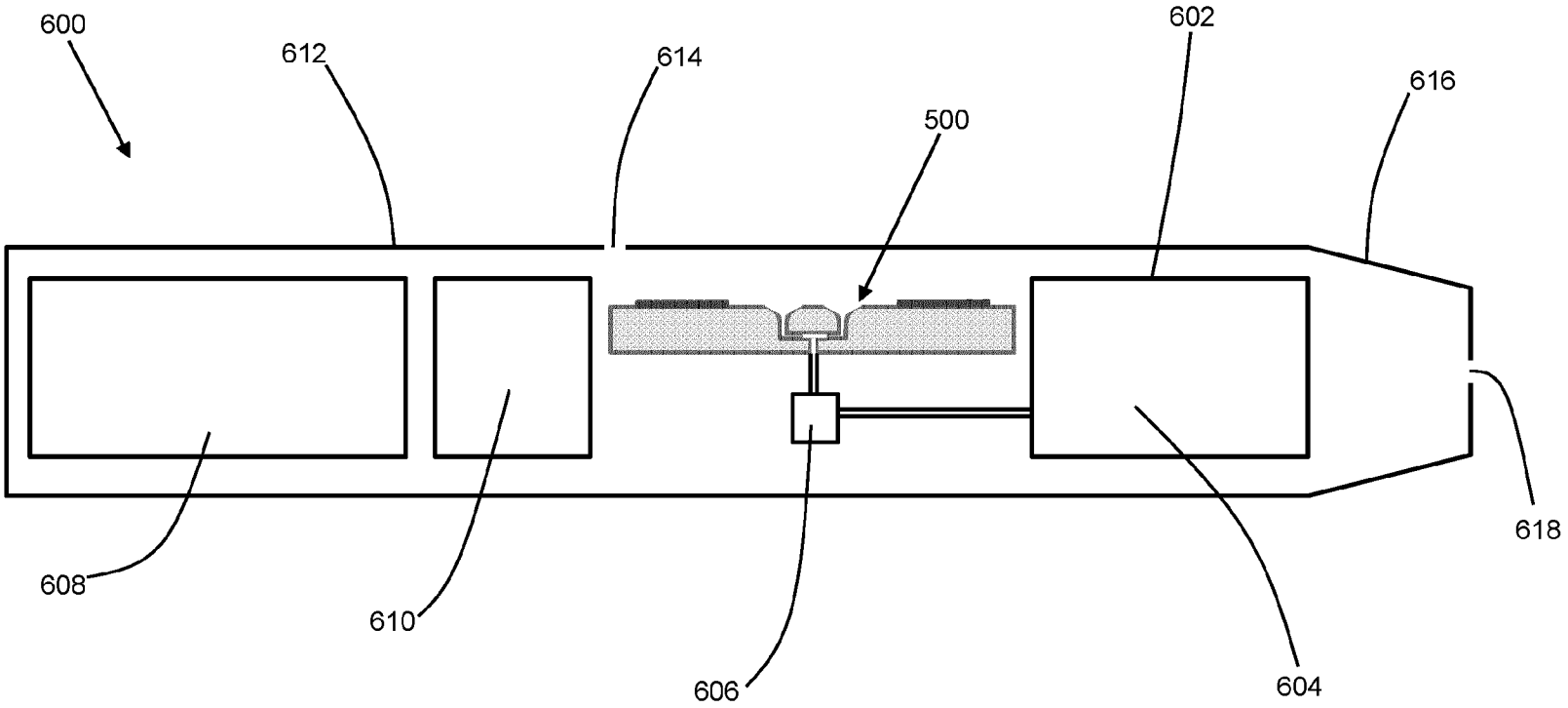
FIG. 18 shows a cross-sectional view of an aerosol-generating device comprising the aerosol-generator of FIG. 15.

FIG. 18 shows a cross-sectional view of an aerosol-generating device 600 comprising the aerosol-generator 500. The aerosol-generating device 600 also comprises a liquid storage portion 602 containing a liquid aerosol-forming substrate 604, and a flow control element 606 comprising a micro-pump. The micro-pump is arranged to supply the liquid aerosol-forming substrate 604 from the liquid storage portion 602 to the inlet 520 of the aerosol-generator 500.

The aerosol-generating device 600 also comprises a power supply 608 comprising a rechargeable battery, and a controller 610. The controller 610 is configured to provide control signals to the flow control element 606 to control a flow rate of the liquid aerosol-forming substrate 604 from the liquid storage portion 602 to the inlet 520 of the aerosol-generator 500. The controller 610 is also configured to supply an electrical current from the power supply 608 to the aerosol-generator 500 to drive the first and second transducers 508, 509.

The aerosol-generating device 600 also comprises a housing 612 in which the aerosol-generator 500, the liquid storage portion 602, the flow control element 606, the power supply 608 and the controller 610 are contained. The housing 612 defines an air inlet 614, a mouthpiece 616, and an air outlet 618. During use, a user draws on the mouthpiece 616 to draw air through the housing 612 from the air inlet 614 to the air outlet 618. Aerosol generated by the aerosol-generator 500 is entrained in the airflow through the housing 612 for delivery to the user.

Figure 19:
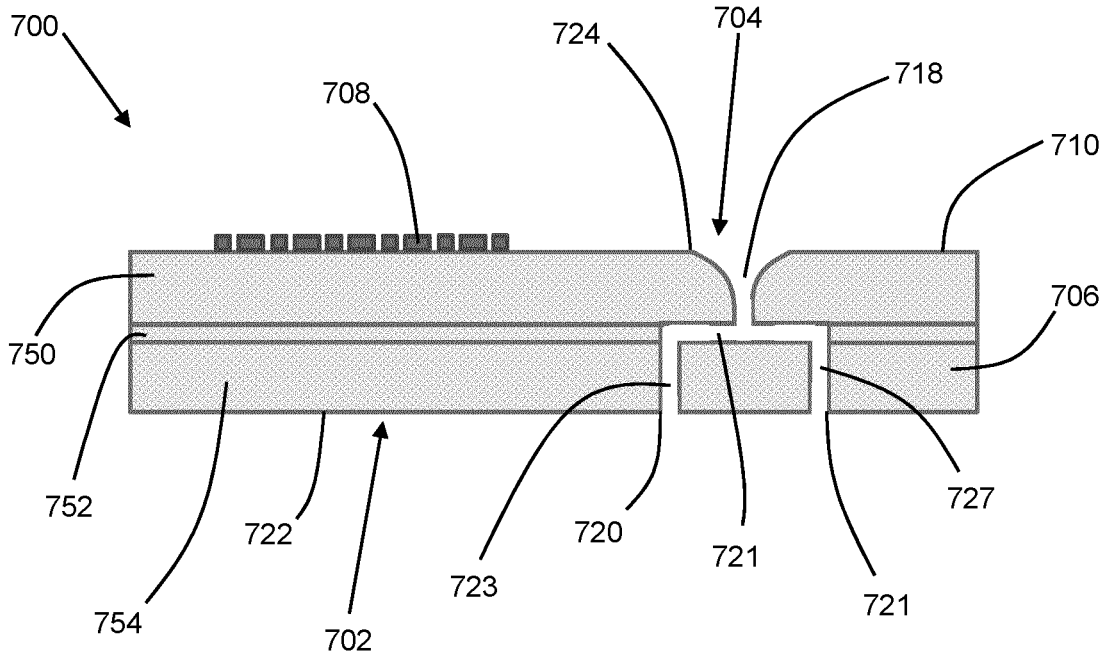
FIG. 19 shows a cross-sectional view of an aerosol-generator according to a sixth embodiment of the present disclosure.

FIG. 19 shows a cross-sectional view of an aerosol-generator 700 according to a sixth embodiment of the present disclosure. The aerosol-generator 700 comprises a surface acoustic wave atomiser 702 and a supply element 704 for supplying a liquid aerosol-forming substrate to the surface acoustic wave atomiser 702.

The surface acoustic wave atomiser 702 comprises a substrate 706 comprising a sheet of piezoelectric material, and a transducer 708 arranged on an active surface 710 of the substrate 706. The transducer 708 is identical to the transducer 108 described with respect to FIG. 1.

The supply element 704 comprises a plurality of interconnected channels extending through the substrate 706 between first and second inlets 720, 721 at a passive surface 722 of the substrate 706 and an outlets 724 at the active surface 710 of the substrate 706.

The plurality of interconnected channels comprises a first inlet channel 723, a second inlet channel 727, a transverse channel 721, and an outlet channel 718. The first inlet channel 723 extends from the first inlet 720. The second inlet channel 727 extends from the second inlet 721. The transverse channel 721 is in fluid communication with the first inlet channel 723 and the second inlet channel 727. The outlet channel 718 extends between the transverse channel 721 and the outlet 724. Advantageously, a first liquid aerosol-forming substrate may be supplied to the first inlet 720 and a second liquid aerosol-forming substrate may be supplied to the second inlet 721. Advantageously, the first and second liquid aerosol-forming substrates may mix in the plurality of interconnected channels during use to form a mixed liquid aerosol-forming substrate. During use, the mixed liquid aerosol-forming substrate is supplied through the plurality of interconnected channels to the outlet 724 for atomisation by surface acoustic waves generated by the transducer 708.

Figure 20:
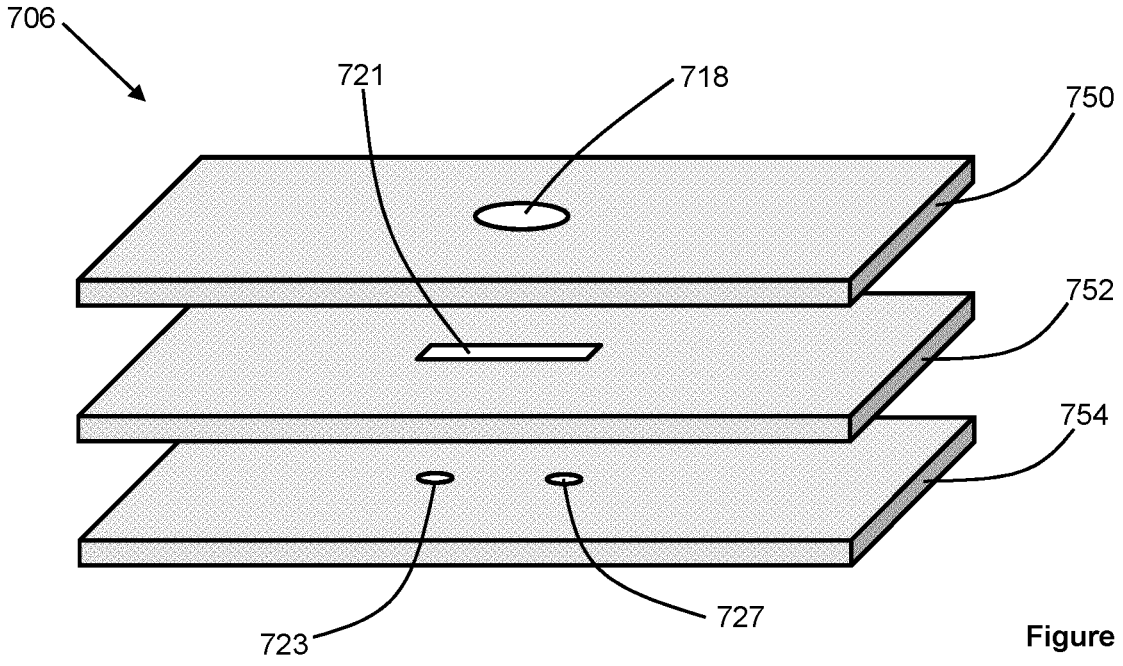
FIG. 20 shows an exploded perspective view of the substrate of the aerosol-generator of FIG. 19.

As shown in FIG. 20, which shows an exploded perspective view of the substrate 706, the substrate 706 is formed from a plurality of layers of substrate material to facilitate the formation of the plurality of interconnected channels. In particular, the substrate 706 comprises first, second and third layers 750, 752, 754 of substrate material. The first layer 750 of substrate material defines the outlet channel 718. The second layer 752 of substrate material defines the transverse channel 721. The third layer 754 of substrate material defines the first and second inlet channels 723, 727. The first, second and third layers 750, 722, 724 of substrate material are adhered together to form the substrate 706.

Figure 21:
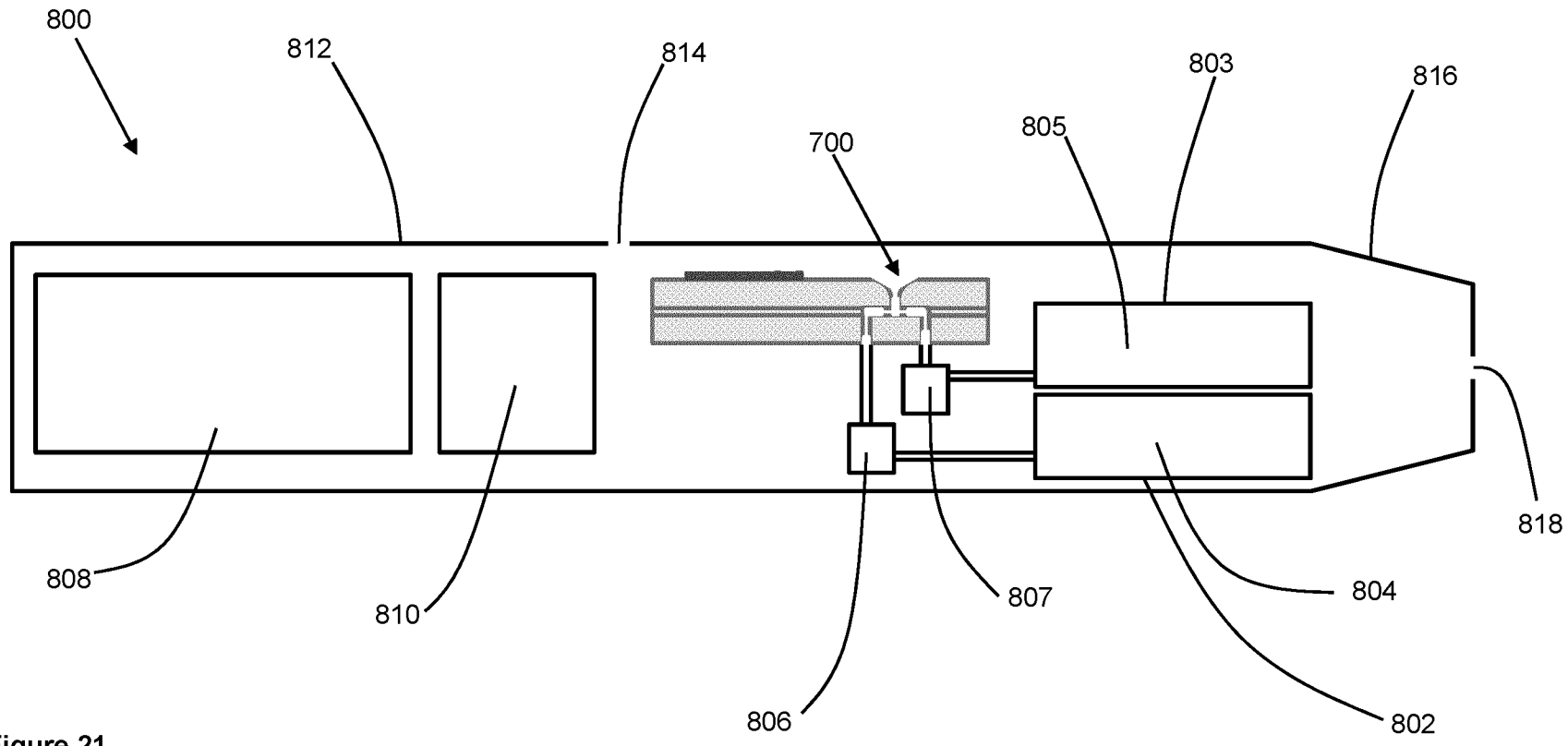
FIG. 21 shows a cross-sectional view of an aerosol-generating device comprising the aerosol-generator of FIG. 19.

FIG. 21 shows a cross-sectional view of an aerosol-generating device 800 comprising the aerosol-generator 700. The aerosol-generating device 800 also comprises a first liquid storage portion 802 containing a first liquid aerosol-forming substrate 804, a second liquid storage portion 803 containing a second liquid aerosol-forming substrate 805, and first and second flow control elements 806, 807 each comprising a micro-pump. The first flow control element 806 is arranged to supply the first liquid aerosol-forming substrate 804 from the first liquid storage portion 802 to the first inlet 720 of the aerosol-generator 700. The second flow control element 807 is arranged to supply the second liquid aerosol-forming substrate 805 from the second liquid storage portion 803 to the second inlet 721 of the aerosol-generator 700.

The aerosol-generating device 800 also comprises a power supply 808 comprising a rechargeable battery, and a controller 810. The controller 810 is configured to provide control signals to the first and second flow control elements 806, 807 to control flow rates of the first and second liquid aerosol-forming substrates 804 to the first and second inlets 720, 721 of the aerosol-generator 700. The controller 810 is also configured to supply an electrical current from the power supply 808 to the aerosol-generator 700 to drive the transducer 708.

The aerosol-generating device 800 also comprises a housing 812 in which the aerosol-generator 700, the first and second liquid storage portions 802, 803, the first and second flow control elements 806, 807, the power supply 808 and the controller 810 are contained. The housing 812 defines an air inlet 814, a mouthpiece 816, and an air outlet 818. During use, a user draws on the mouthpiece 816 to draw air through the housing 812 from the air inlet 814 to the air outlet 818. Aerosol generated by the aerosol-generator 700 is entrained in the airflow through the housing 812 for delivery to the user.

The invention claimed is:

1. An aerosol-generator for an aerosol-generating device, the aerosol-generator comprising:

a surface acoustic wave atomiser comprising:

a substrate comprising a first side defining an active surface defining at least one atomisation region, and a second side opposite the first side and defining a second surface, and at least one transducer positioned on the active surface and being configured to generate surface acoustic waves on the active surface; and a supply element arranged to supply a liquid aerosol-forming substrate to the at least one atomisation region, the supply element comprising a channel extending through the substrate between an inlet at the second surface and an outlet at the active surface, wherein the inlet is configured to receive a supply of the liquid aerosol-forming substrate and wherein the outlet is positioned within the at least one atomisation region of the active surface, and wherein the channel has at least one of a cross-sectional area that varies in a direction from the inlet to the outlet and a portion that extends in a non-perpendicular direction with respect to the active surface.

2. The aerosol-generator according to claim 1, wherein at least a portion of the channel has a cross-sectional area that increases in the direction from the inlet to the outlet.

3. The aerosol-generator according to claim 1, wherein at least a portion of the channel has a funnel shape, a conical shape, or a wedge shape.

4. The aerosol-generator according to claim 1, wherein at least a portion of the channel is curved.

5. The aerosol-generator according to claim 1, wherein at least a portion of the channel at the outlet is curved to form a continuous transition between the channel and the active surface.

6. The aerosol-generator according to claim 1, wherein at least a portion of the channel at the outlet extends tangentially with respect to the active surface.

7. The aerosol-generator according to claim 1, wherein the outlet comprises a first side and a second side opposite the first side, wherein the first side is positioned between the second side and the at least one transducer, wherein the channel comprises a first outlet portion at the first side of the outlet and a second outlet portion at the second side of the outlet, wherein the first outlet portion extends tangentially with respect to the active surface, and wherein the second outlet portion extends perpendicularly with respect to the active surface.

8. The aerosol-generator according to claim 1, wherein the substrate defines a recess at the active surface, wherein the recess extends between the at least one transducer and the outlet, wherein the substrate comprises a wall at least partially defining the recess, wherein the wall extends perpendicularly with respect to the active surface, and wherein the wall is positioned to reflect surface acoustic waves from the at least one transducer towards the outlet.

9. The aerosol-generator according to claim 1, wherein the channel comprises a plurality of interconnected channels extending through the substrate between the inlet and the outlet.

10. The aerosol-generator according to claim 9, wherein the inlet comprises a single inlet, wherein the outlet comprises a plurality of outlets, and wherein the plurality of interconnected channels provides fluid communication between the inlet and each of the plurality of outlets.

11. The aerosol-generator according to claim 9, wherein the outlet comprises a single outlet, wherein the inlet comprises a plurality of inlets, and wherein the plurality of interconnected channels provides fluid communication between the outlet and each of the plurality of inlets.

12. The aerosol-generator according to claim 1, wherein the substrate is a laminate material comprising a plurality of layers of substrate material, wherein at least one of the layers of substrate material defines the outlet, wherein at least one of the layers of substrate material defines the inlet, and wherein at least one of the layers of substrate material defines the channel.

13. An aerosol-generating device, comprising:

an aerosol-generator according to claim 11;

a controller configured to control the at least one transducer;

a power supply;

a first liquid storage portion configured to receive a first liquid aerosol-forming substrate, wherein the first liquid storage portion is in fluid communication with a first inlet of the plurality of inlets; and a second liquid storage portion configured to receive a second liquid aerosol-forming substrate, wherein the second liquid storage portion is in fluid communication with a second inlet of the plurality of inlets.

14. An aerosol-generating device, comprising:

an aerosol-generator according to claim 1;

a controller configured to control the at least one transducer;

a power supply; and a liquid storage portion configured to receive a liquid aerosol-forming substrate, wherein the supply element is further arranged to supply liquid aerosol-forming substrate from the liquid storage portion to the at least one atomisation region.

* * * * *